US005899621A

United States Patent [19]

Wang

[11] Patent Number: 5,899,621

[45] Date of Patent: May 4, 1999

[54] LIPSTICK SWIVEL MECHANISM WITH BRAKE FUNCTION

[75] Inventor: Chun Te Wang, Hsin-chu, Taiwan

[73] Assignee: Der Kwei Cosmetic Packaging Co., Limited, Hsin-Chu, Taiwan

[21] Appl. No.: 09/025,477

[22] Filed: Feb. 18, 1998

[51] Int. Cl.[6] ..... B43K 21/08

[52] U.S. Cl. ..... 401/78; 401/77

[58] Field of Search ..... 401/78, 77, 75, 401/68, 55

[56] References Cited

U.S. PATENT DOCUMENTS

| | | | |
|---|---|---|---|
| 2,469,631 | 5/1949 | Broder | 401/78 |
| 5,649,777 | 7/1997 | Holloway | 401/78 |
| 5,791,799 | 8/1998 | Oehlhorn | 401/78 |

*Primary Examiner*—David J. Walczak
*Attorney, Agent, or Firm*—Bacon & Thomas

[57] ABSTRACT

A lipstick swivel mechanism has a brake function, by which push back of the lipstick when the lipstick is being pressed is effectively hindered. An additional protrusion and a corresponding beveled helical groove are provided on the inner body and the spiral of the dispenser. When the reaction force of applying the lipstick to the consumer's lips pushes the lipstick cup down the dispenser, this reaction force is transmitted to the protrusion and the beveled helical groove so as to increase the frictional force, which impedes the relative rotation of inner body and spiral, between them; thereby push back of the lipstick cup is obstructed. Besides, the beveled helical groove is specially designed so as to make such brake function effective across the entire travel of the lipstick cup.

1 Claim, 4 Drawing Sheets

LIPSTICK SWIVEL MECHANISM WITH BRAKE FUNCTION

BACKGROUND OF THE INVENTION

1. Field of the Invention

The present invention relates to a lipstick swivel mechanism and, more particularly, to a lipstick swivel mechanism having a brake function so as to avoid push back of the lipstick during operation.

2. Description of the Related Art

Conventional lipstick dispensers typically have an outer helical cam track sleeve and a longitudinal track inner body rotatable inside the cam sleeve to axially proper and retract a lipstick cup with a lug or lugs that track in the cam track and in the longitudinal track.

A problem found in certain conventional lipstick dispensers is the problem of push back. Push back may occur when the consumer is applying the lipstick to the consumer's lips, that is, the reaction force for applying the lipstick pushes the lipstick and the lipstick cup down the helical tracks of the dispenser. Push back is generally prevented when the lipstick is fully extended by providing horizontal locking tracks at the upper end of the inner body longitudinal track. However, if the consumer does not fully extend the lipstick (as often occurs when a new lipstick is being used), the locking tracks are unavailing since the lipstick cup is not extended sufficiently to engage in the locking tracks. Such push back is most noticeable in fast spiral dispensers, in which the cam tracks extend less than or around 360 degrees of the dispenser, which have relatively higher cam angles, so that pressure applied on the lipstick cup tends to push the cup and lipstick back down the cam and inner body tracks. This problem may be less acute in dispensers having slow spiral tracks, such as double or triple turn dispensers. However, for the convenience of a consumer, a fast spiral dispenser is preferable as it is easier and more elegant to use.

SUMMARY OF THE INVENTION

Therefore, the object of the invention is to provide a lipstick swivel mechanism with a brake function which reduces the push back of lipstick that can occur when a pressure is applied to the lipstick, and the brake function is effective across the entire travel of the lipstick cup.

According to the present invention, a lipstick swivel mechanism having a brake function, by which push back of the lipstick is effectively hindered, is disclosed. For the preferred embodiment of the invention, a beveled helical groove is provided on the outer surface of the inner body of the dispenser, and an additional protrusion corresponding to the helical groove is disposed on the inner surface of the lower part of the spiral. When the reaction force for applying the lipstick to the consumer's lips pushes the lipstick cup down the dispenser, this reaction force is transmitted to the protrusion of the spiral and the beveled helical groove of the inner body through the lug of the lipstick cup. The angle of the beveled helical groove is designed such that the force rotating the spiral decreases and that the transmitted reaction force increases the frictional force between the protrusion and the beveled helical groove, which impedes the relative rotation of inner body and spiral, thereby push back of the lipstick cup is obstructed. Besides, the beveled helical groove is specially designed so as to make such hindering function be effective across the entire travel of the lipstick cup.

The present invention is further illustrated hereinafter by the preferred embodiment and the appended drawings.

DESCRIPTION OF THE PREFERRED EMBODIMENT

Figure 1:
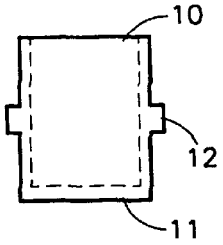
FIG. 1 schematically shows the structure of the lipstick cup of the lipstick dispenser according to the present invention.
Figure 2A:
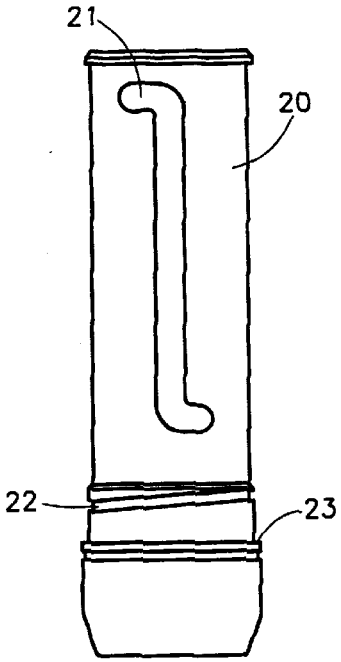
FIG. 2A is a front view of the inner body of the lipstick dispenser according to the present invention.
Figure 2B:
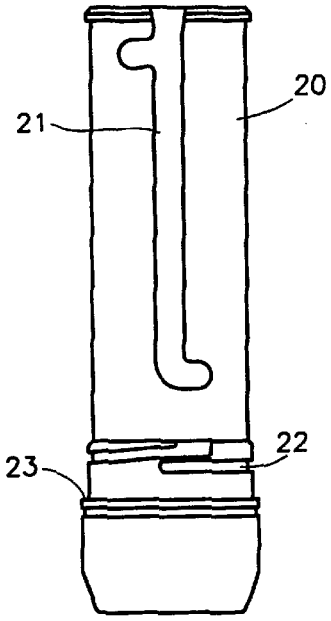
FIG. 2B is a rear view of the inner body of the lipstick dispenser according to the present invention.
Figure 3A:
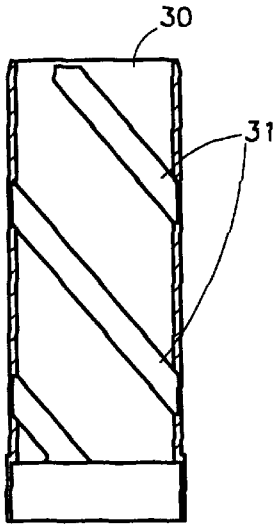
FIG. 3A shows a cross sectional view of the spiral of the dispenser along its longitudinal axis.
Figure 3B:
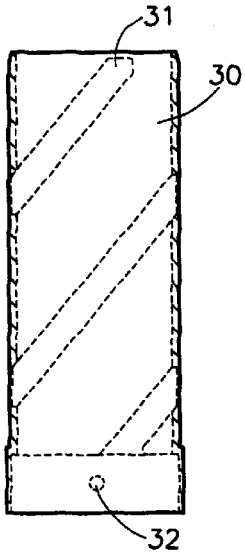
FIG. 3B is an elevation view showing half of the spiral which is partially cut off along the longitude axis of the spiral of the dispenser.

FIG. 1 shows the structure of the lipstick cup 10 of the lipstick dispenser according to the preferred embodiment of the present invention. The lipstick cup 10 consists a lipstick holder 11 for containing the lipstick and two lugs 12 for propelling/retracting the lipstick cup 10. Two lugs 12 extend outwardly from the outer surface of the holder 11. Referring now to FIGS. 2A and 2B, the inner body 20 of the dispenser includes two guiding slots 21 for limiting the lugs 12 to move upward or downward, and a brake groove 22 for hindering the push back of the lipstick cup 10. FIG. 3A is a cross sectional view of the spiral 30 showing the inner surface of the spiral 30. Two parallel helical guiding tracks 31 in which the lugs 12 are introduced are located on the inner surface of the spiral 30 so as to convert the rotary force of the spiral 30 into the upward or downward force of the lipstick cup 10. A protrusion 32, corresponding to the brake groove 22 of the inner body 20, extends inwardly from the lower portion of the inner surface of the spiral 30 (FIG. 3B). The two helical guiding tracks 31 are located 180° apart and extend along a substantial length around the inner surface of the spiral 30, wherein each guiding track 31 extends around 360 degrees of the dispenser.

Figure 4:
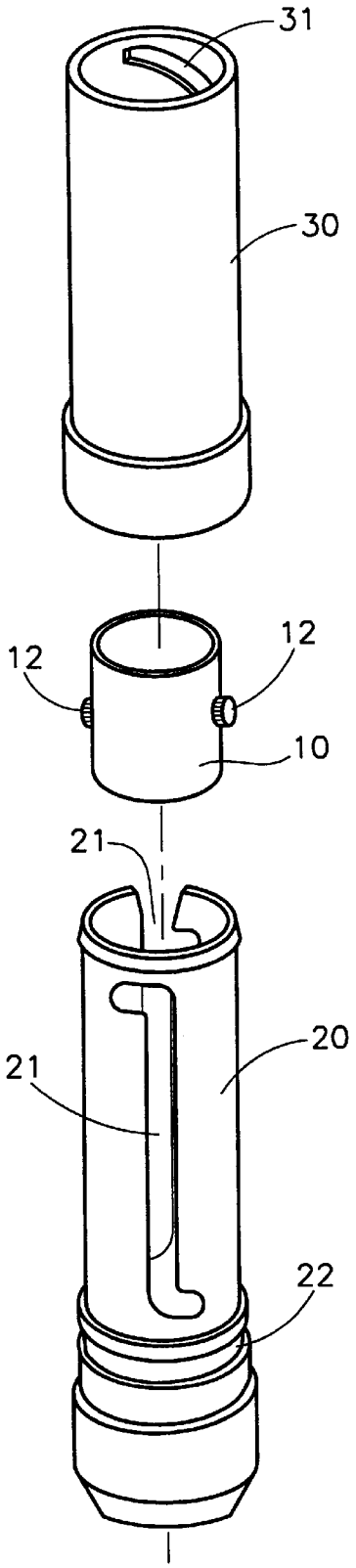
FIG. 4 is an exploded view of the lipstick dispenser according to the present invention.
Figure 5A:
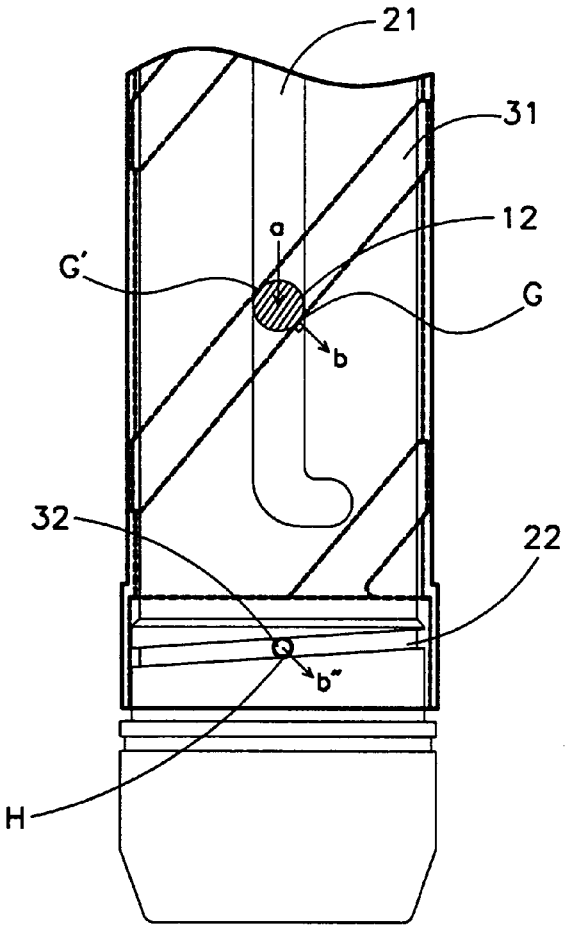
FIG. 5A is a schematic diagram showing part of the swivel mechanism according to the present invention.

When the lipstick cup 10, the tubular inner body 20, and the tubular spiral 30 are assembled together, as shown in FIG. 4, the lugs 12 introduce into the guiding tracks 31 through the guidging slots 21 so as to move the lipstick cup 10 upward or downward by rotating the spiral 30. Referring now to FIG. 5A, let the inner body 20 be fixed, when the spiral 30 is leftward rotated (that is, clockwise as seen from the top of the dispenser), the rotating force of the spiral 30 is transmitted to the lug 12 through the contacting point G between the guiding track 31 and the lug 12 in a up-left direction vertical to the edge of the guiding track 31; that is, the reaction force of force b. Since the guiding slots 21 of the fixed inner body 20 limit the movement of the lugs 12 to be upward or downward only, the guiding tracks 31 push the lugs 12 upward, whereby the lipstick cup 10 is propelled. On the contrary, when the spiral 30 is rightward rotated (that is, counterclockwise as seen from the top of the dispenser), the rotating force of the spiral 30 is transmitted to the lug 12 through the contacting point G' between the guiding track 31 and the lug 12 in a down-right direction which is vertical to the guiding track 31. Since movement of the lugs 12 are limited by the guiding slots 21 of the fixed inner body 20 to be upward or downward only, the guiding tracks 31 push the lug 12 downward, whereby the lipstick cup 10 is retracted.

Figure 5B:
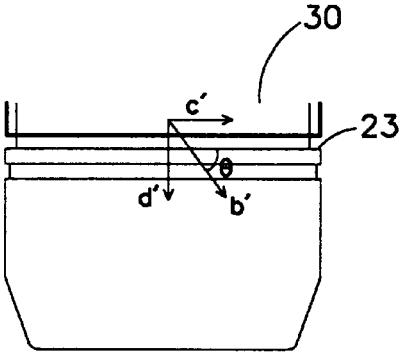
FIG. 5B shows how the reaction forces act in a conventional dispenser.

When applying the lipstick contained by the lipstick holder 11 to the lips of a consumer, the reaction force a from the lips pushes the lipstick cup 10 downward. For a conventional lipstick dispenser, action force b is transmitted through the contacting point G to the interface between the lower edge of the spiral 30 and the shoulder 23 of the inner body 20, as seen in FIG. 5B. The action force between the lower edge of the spiral 30 and the shoulder 23 of the inner body 20 is denoted by b'. Force b' can be divided into two different forces, c' and d', that are perpendicular to each other. Force c' is parallel to the lower edge of the spiral 30, while the force d' is perpendicular to the lower edge of the spiral 30. If the force c' does not exceed the maximum force of static friction, i.e. $c' \leqq \mu_s \times d'$ wherein $\mu_s$ is the coefficient of static friction, the lipstick cup 10 remain stationary. When the force c exceeds the maximum force of static friction, i.e. $c' > \mu_s \times d'$, the spiral 30 rotates counterclockwise (seen from the top), thereby the lipstick cup 10 slides downward and the lipstick is pushed back.

Figure 5C:
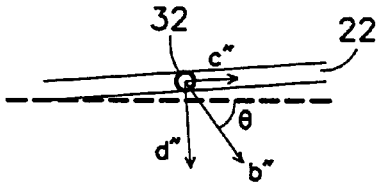
FIG. 5C shows how the reaction forces act in a dispenser according to the present invention.

Considering now to the brake mechanism of the preferred embodiment according to the present invention, as shown in FIG. 5C, when applying the lipstick to the lips of a consumer, the reaction force from the lips pushes the lipstick cup 10 downward. An action force b is transmitted through the contacting point G between lugs 12 and guiding grooves 31 to the contacting point H between the protrusion 32 of the spiral 30 and the brake groove 22 of the inner body 20, as shown in FIG. 5C. The action force between the protrusion 32 of the spiral 30 and the brake groove 22 of the inner body 20 is denoted by b". Force bb" can be divided into two different forces, c" and d", that are perpendicular to each other. Force c" is parallel to the edge of the brake groove 22 of inner body 20, and the force d" is perpendicular to the edge of the brake groove 22. Since the value of coefficient of static friction depends on the nature of both the surfaces in contact, and both the inner body 20 and the spiral 30 are made of one material, the coefficient of static friction between the protrusion 32 of the spiral 30 and the brake groove 22 of the inner body 20 is substantially equal to the coefficient of static friction between the lower edge of the spiral 30 and the shoulder 23 of the inner body 20, that is, $\mu_s$. If the force c" does, not exceed the maximum force of static friction, i.e. $c'' \leqq \mu_s \times d''$, the lipstick cup 10 remain stationary. When the force c" exceeds the maximum force of static friction, i.e. $c'' > \mu_s \times d''$, the lipstick cup 10 slides downward and the lipstick pushes back.

Comparing FIG. 5B with FIG. 5C, the forces which tend to rotate the spiral (by which the lipstick may push back) are c' and c", respectively. The maximum forces of static friction which keep the spirals of the conventional dispenser and the present dispenser stationary are $\mu_s \times d'$ and $\mu_s \times d''$, respectively. The transmitted reaction forces b' and b" are parallel and equal to each other, therefore, we can easily see from FIG. 5B and FIG. 5C that $c' > c''$ and $d' < d''$. That is, $c' > \mu_s \times d'$ occurs more easily than $c'' > \mu g \times d''$ does. In other words, the lipstick of the conventional dispenser push back easily during operation, while the brake mechanism of the dispenser according to the present invention can effectively hinders such an undesired "push back" of the lipstick.

Figure 6A:
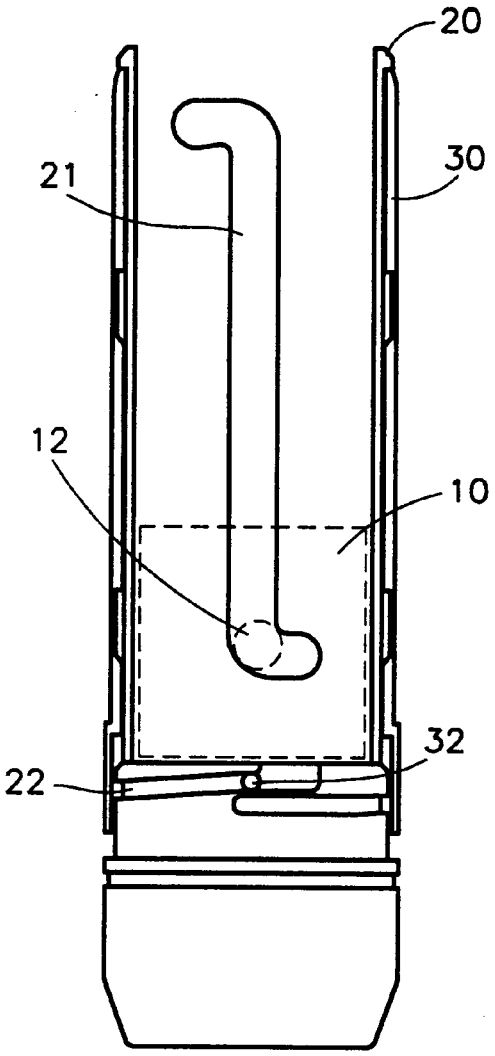
FIG. 6A is a schematic diagram showing the relative locations of the protrusion and the lipstick cup.
Figure 6B:
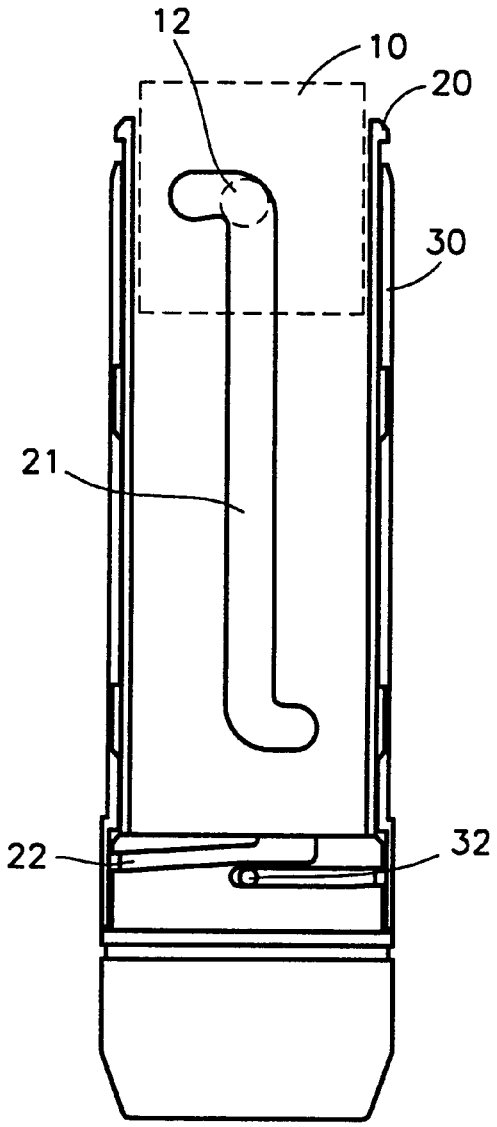
FIG. 6B is a schematic diagram showing another relative locations of the protrusion and the lipstick cup.

The beveled helical brake groove 22 is specially designed such that the protrusion 32 sits at the upper end of the brake groove 22 when the lug 12 is at the lower end of the guiding slot 21 (FIG. 6A), and the protrusion 32 locates at the lower end of the brake groove 22 when the lug 12 is at the upper end of the guiding slot 21 (FIG. 6B). On other words, the break mechanism is effective across the entire travel of the lipstick cup 10.

The preferred embodiment of the present invention described above is for illustrating only, however, it is by no means for limiting the present invention. Modifications and variations can be made without departing from the true spirit of the invention. For example, the position for disposing the brake mechanism may be shifted. Therefore, the scope of the present invention is intended to cover the following appended claims.

I claim:

1. A lipstick swivel mechanism having a brake function, comprising:

a lipstick cup having a holder for containing a lipstick and at least one lug protruding outwardly from the outer surface of said holder;

an inner body having at least one guiding slot and a helical brake groove; and a spiral having at least one guiding track and a protrusion, said at least one lug of said lipstick cup being introduced into said at least one guiding track of said spiral through said guiding slot of said inner body for moving said lipstick cup upward or downward, while said protrusion of said spiral is introduced into said helical brake groove of said inner body so as to hinder movement of said lipstick cup caused by a reaction force between said protrusion and said helical brake groove when said lipstick cup is pressed downward.

* * * * *